United States Patent [19]

Sogawa

[11] Patent Number: 4,884,548

[45] Date of Patent: Dec. 5, 1989

[54] FUEL INJECTION CONTROL SYSTEM FOR AN AUTOMOTIVE ENGINE

[75] Inventor: Yoshiyuki Sogawa, Tokyo, Japan

[73] Assignee: Fuji Jukogyo Kabushiki Kaisha, Tokyo, Japan

[21] Appl. No.: 266,917

[22] Filed: Nov. 3, 1988

[30] Foreign Application Priority Data

Nov. 10, 1987 [JP] Japan ..... 62-284556

[51] Int. Cl.[4] ..... F02D 41/10; F02D 41/12

[52] U.S. Cl. ..... 123/492; 123/478; 123/493

[58] Field of Search ..... 123/478, 480, 486, 488, 123/492, 493, 494

[56] References Cited

U.S. PATENT DOCUMENTS 4,051,818 10/1977 Volckers ..... 123/494
4,227,750 10/1980 Takase et al. ..... 123/492
4,240,383 12/1980 Horbelt et al. ..... 123/492
4,411,235 10/1983 Shinoda et al. ..... 123/494 X
4,770,147 9/1988 Sogawa ..... 123/489

FOREIGN PATENT DOCUMENTS 41230 3/1983 Japan .
48720 3/1983 Japan .

*Primary Examiner*—Tony M. Argenbright
*Attorney, Agent, or Firm*—Martin A. Farber

[57] ABSTRACT

A basic injection pulse width is derived from a table in accordance with speed of an engine and throttle position of a throttle valve of the engine. A time constant for providing a first order lag is calculated from variables dependent on the engine speed and the throttle position. The basic injection pulse width is corrected with the time constant, thereby producing a fuel injection pulse width signal for operating a fuel injector of the engine.

2 Claims, 7 Drawing Sheets

THROTTLE OPENING DEGREE

INTAKE AIR PRESSURE

Tp*

LEAN
AIR-FUEL MIXTURE
RICH
A
B

Tp

LEAN
AIR-FUEL MIXTURE
A/F
RICH
TIME

FUEL INJECTION CONTROL SYSTEM FOR AN AUTOMOTIVE ENGINE

BACKGROUND OF THE INVENTION

The present invention relates to a system for controlling the fuel injection of an automotive engine in dependence on a throttle opening degree and engine speed.

In a known fuel injection system, a basic fuel injection pulse width Tp is calculated in dependence on throttle opening degree $\theta$ and engine speed N. The basic pulse width Tp are stored in a table shown in FIG. 9 and are derived for controlling the fuel injection during the operation of the engine. At a transient state of the operation of the engine, the basic fuel injection pulse width Tp is corrected in dependence on various factors such as engine speed, pressure in an intake passage, coolant temperature and vehicle speed, so that air-fuel mixture is prevented from becoming rich or lean (see for example, Japanese Pat. Laid Open Nos. 58-48720 and 58-41230).

However, since there is a space between the throttle valve and a cylinder of the engine, such as a chamber formed downstream of the throttle valve, changing of actual amount of inducted air per engine cycle in response to the change of the throttle opening degree during the transient state is delayed. Accordingly, when the throttle valve is rapidly opened, the air-fuel mixture becomes rich. To the contrary, when the throttle valve is rapidly closed, the air-fuel ratio becomes lean.

In order to overcome such a defect, it is preferable to estimate the quantity of the air inducted in the cylinder of the engine in one cycle and to correct the basic injection pulse width based on the estimated quantity.

Referring to FIGS. 2*a* and 2*b*, the intake system schematically illustrated in FIG. 2*a* approximately equals to an electric circuit of FIG. 2*b*. Namely, the pressure P in the intake passage 2 at downstream of the throttle valve 3 and chamber 5 corresponds to the voltage V and a quantity $Q_\theta$ corresponds to the current $I_\theta$ in FIG. 2*b*. Po represents a pressure at upstream of the throttle valve 3 and corresponds to the voltage Vo in FIG. 2*b*. A resistance $R_\theta$ corresponds to a resistance at the throttle valve 3 and a resistance Re corresponds to a resistance in the engine 1. In other words, $R_\theta$ is a variable determined by the throttle valve opening degree $\theta$, and Re is a variable determined by the engine speed N. The relationships among the voltages V, Vo and resistances $R_\theta$, Re can be expressed as the following equations.

$$C \cdot dV/dt = (Vo - V)/R_\theta - V/Re$$

$$V = \{Re/(R_\theta + Re)\} \times Vo \times (1 - e^{-t/\tau})$$

(initial value = 0)

$$\tau = C \times R_\theta \cdot Re/(R_\theta + Re)$$

where C is a constant for the capacity of the intake passage in downstream of the throttle valve and the throttle chamber 5, and $\tau$ is a time constant. It will be seen that the pressure P delays with respect to engine speed N and the throttle opening degree $\theta$ with a first order lag determined by the time constant $\tau$.

Assuming the basic injection pulse width Tp proportional to the pressure P, $Tp=KP$, where K is a constant dependent on volumetric efficiency. Namely, the basic injection pulse width Tp varies in accordance with the pressure P. Therefore, it is preferable that the basic injection pulse width Tp has a time lag of first order determined by the time constant $\tau$, with respect to a basic injection pulse width Tp* obtained from a table in accordance with throttle opening degree $\theta$ and engine speed N.

SUMMARY OF THE INVENTION

Accordingly, the object of the present invention is to provide a system for controlling the fuel injection where air-fuel mixture is prevented from becoming rich or lean during transient states and kept at an optimum air-fuel ratio by compensating a delay in amount of inducted air.

According to the present invention, there is provided a system for controlling fuel injection of an engine for a motor vehicle having an intake passage, a throttle valve provided in the intake passage, and a fuel injector, the system comprising an engine speed sensor producing an engine speed signal dependent on speed of the engine, and a throttle position sensor producing a throttle position signal dependent on the opening degree of the throttle valve.

The system comprises determining means for producing a basic injection pulse width signal in accordance with the engine speed signal and throttle position signal, calculator means for producing a delay signal from variables dependent on the engine speed signal and the throttle position signal, correcting means for correcting the basic injection pulse width signal with the delay signal and for producing a fuel injection pulse width signal for operating the fuel injector.

In an aspect of the invention, the delay signal is a time constant for providing a first order lag.

The other objects and features of this invention will become understood from the following description with reference to the accompanying drawings.

DETAILED DESCRIPTION OF THE PREFERRED EMBODIMENT

Figure 1:
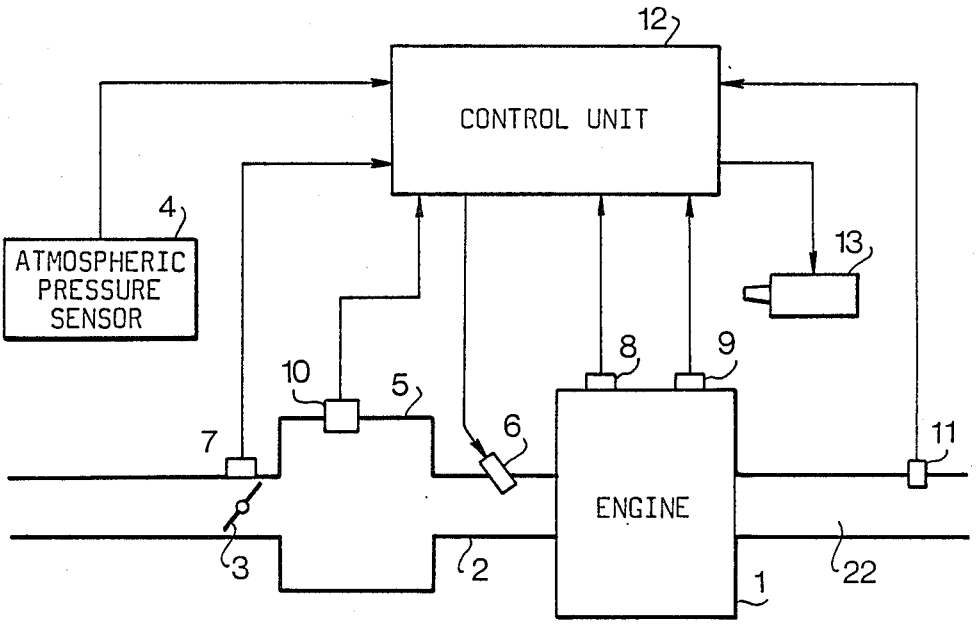
FIG. 1 is a schematic diagram showing a system according to the present invention.
Figure 2B:
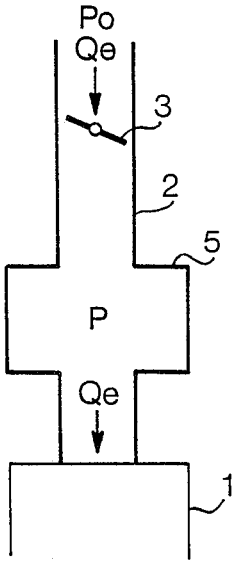
FIGS. 2*a* and 2*b* are schematic views of an intake system.
Figure 2A:
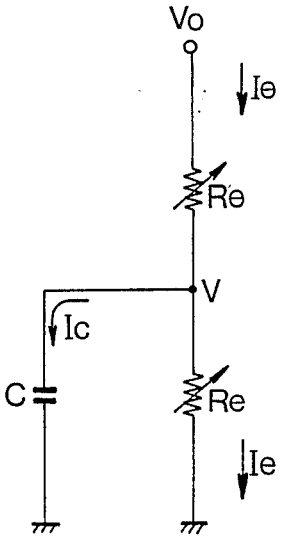
Figure 6:
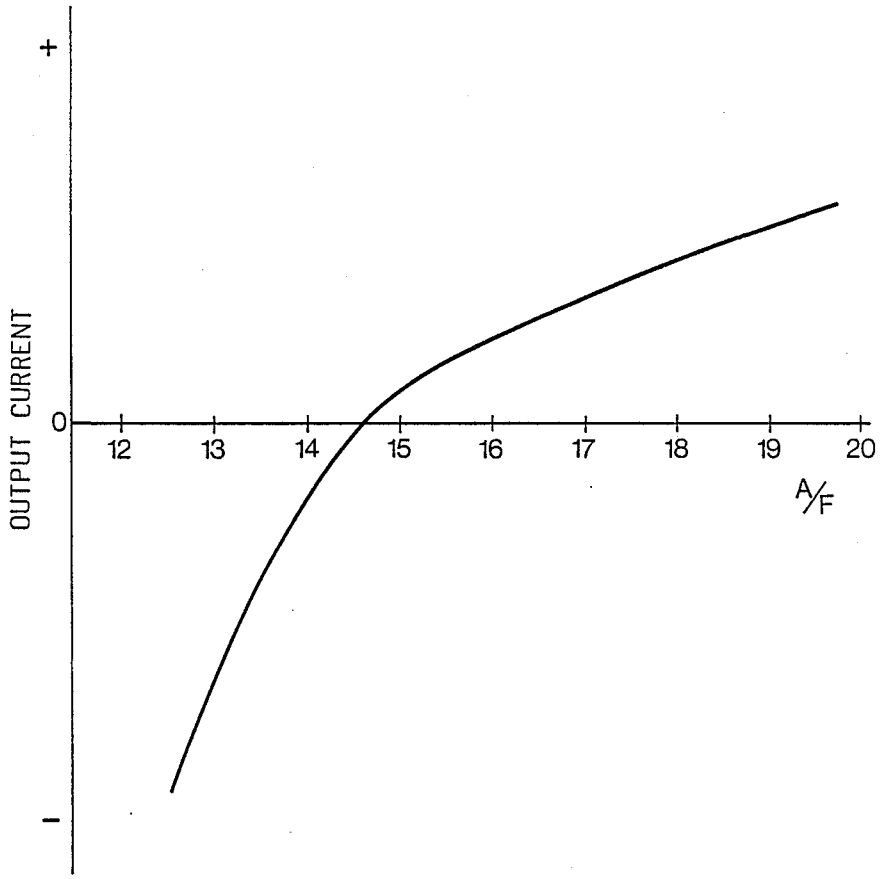
FIG. 6 is a graph showing a characteristic of an output signal of an $O_2$-sensor.

Referring to FIG. 1, in an intake passage 2 of an engine 1, a throttle chamber 5 is provided downstream of a throttle valve 3 so as to absorb the pulsation of intake air. Multiple fuel injectors 6 are provided in the intake passage at adjacent positions of intake valve so as to supply fuel to each cylinder of the engine 1. A throttle position sensor 7, coolant temperature sensor 8, crank angle sensor 9, intake air temperature sensor 10 and an atmospheric pressure sensor 4 are provided for detecting respective conditions. An $O_2$-sensor 11 having a characteristic shown in FIG. 6 is provided in an exhaust passage 22. Output signals of the sensors are applied to a control unit 12 comprising a microcomputer to operate the fuel injectors 6 and an ignition coil 13.

The control unit 12 comprises a ROM which stores basic injection pulse widths Tp* for steady state in the form of a table with coordinates of engine speed N and throttle opening degree $\theta$.

Figure 3:
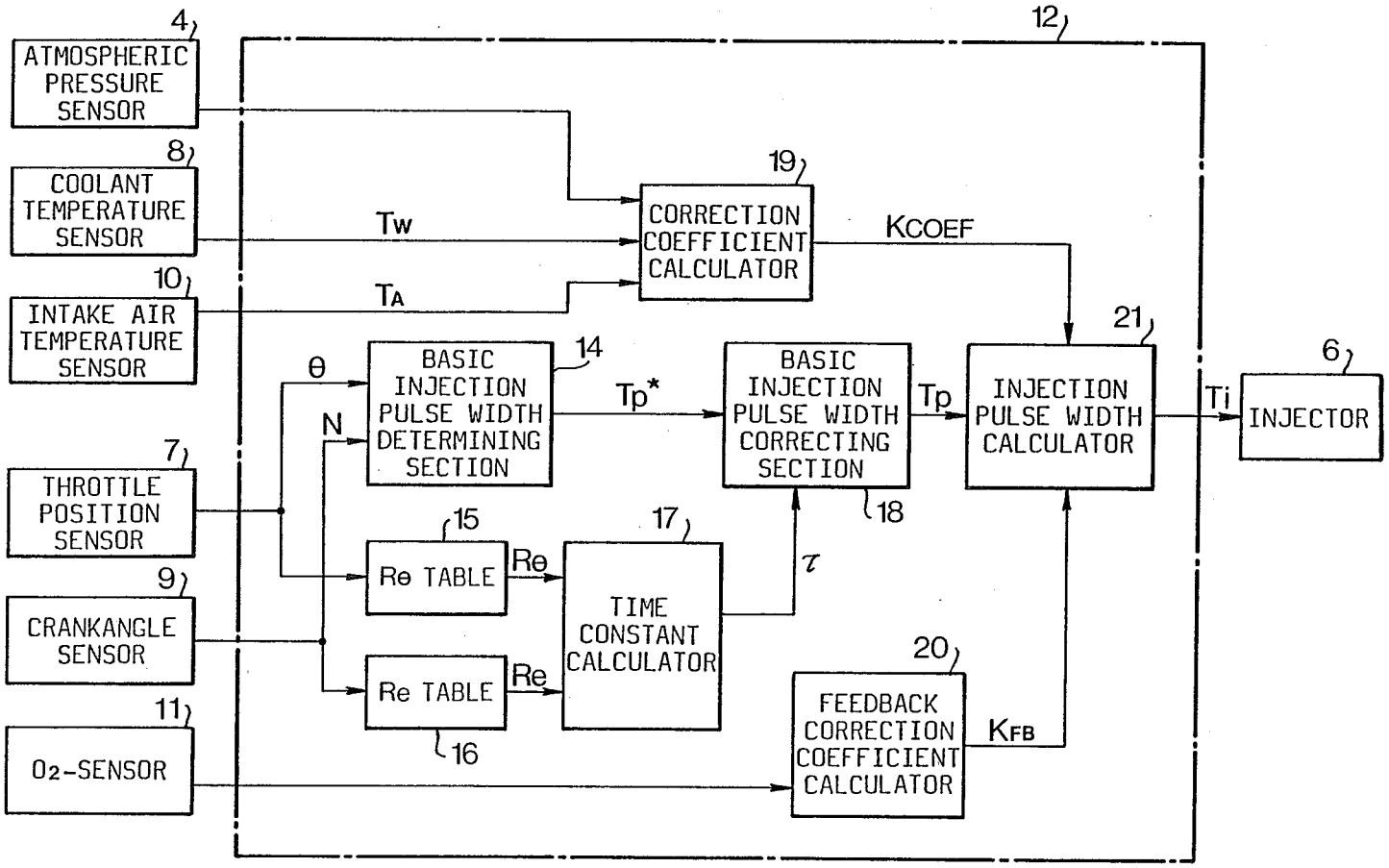
FIG. 3 is a block diagram showing a control unit of the present invention.
Figure 7:
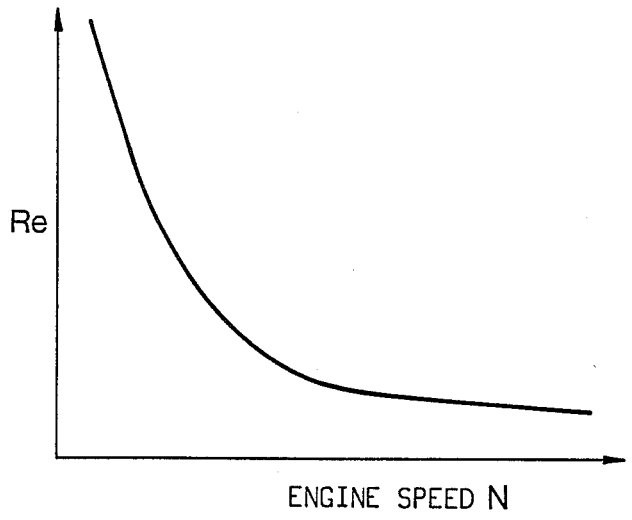
FIG. 7 and 8 are graphs showing relationships between resistances Re and engine speed N, and between $R_\theta$ and throttle opening degree $\theta$.
Figure 8:
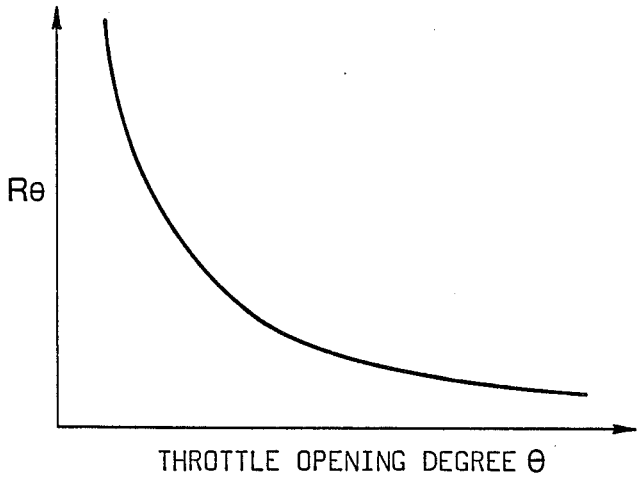
Figure 9:
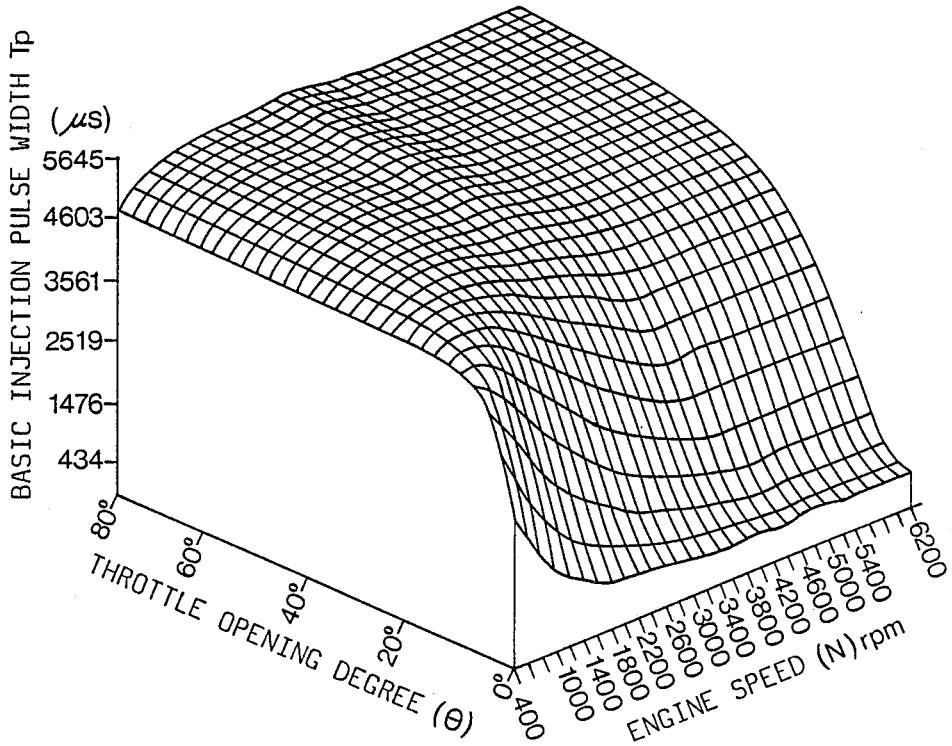
FIG. 9 shows a basic injection pulse width table.

Referring to FIG. 3, the control unit 12 has a basic injection pulse width determining section 14 having a table which is supplied with an engine speed N from the crank angle sensor 9 and a throttle opening degree $\theta$ from the throttle position sensor 7 for determining basic injection pulse width Tp* for steady state dependent on data from the table in the ROM. As shown in FIGS. 7 and 8, a resistance Re can be obtained as a function of engine speed N and a resistance $R_\theta$ can be obtained as a function of the opening degree $\theta$ of the throttle valve 3. Accordingly, resistance $R_\theta$ and Re are stored in tables 15, 16, respectively as the functions of $\theta$ and N. The resistances $R_\theta$ and Re are applied to a time constant calculator 17 where a time constant $\tau$ for a first order lag of a pressure P in the intake passage is calculated as follows.

$$\tau = C \times R_\theta \cdot Re/(R_\theta + Re)$$

where C is a constant for the capacity of the intake passage at the downstream of the throttle valve and the throttle chamber 5.

The time constant $\tau$ is applied to a basic injection pulse width correcting section 18 to correct the basic injection pulse width Tp*. An injection pulse width $Tp_n$ is calculated, using a pulse width $Tp_{n-1}$ obtained at the previous calculation, as follows.

$$Tp_n = (Tp^* + \tau/\Delta t \cdot Tp_{n-1})/(1 + \tau/\Delta t)$$

where $\Delta t$ is an interval between calculations.

The control unit 12 further has a correction coefficient calculator 19 where a miscellaneous correction coefficient $K_{COEF}$ is calculated in dependence on an atmospheric pressure, a coolant temperature Tw and intake air temperature $T_A$ applied from the sensors 4, 8 and 10. A feedback correction coefficient calculator 20 is provided for calculating a feedback correction coefficient $K_{FB}$, in dependence on an output voltage of the $O_2$-sensor 11.

The corrected basic injection pulse width Tp and coefficients $K_{COEF}$ and $K_{FB}$ are applied to an injection pulse width calculator 21 where an output injection pulse width Ti is calculated by the following equation.

$$Ti = Tp \times K_{COEF} \times K_{FB} + Ts$$

where Ts is a constant for voltage correction. The pulse width Ti is applied to the injectors 6.

Figure 4:
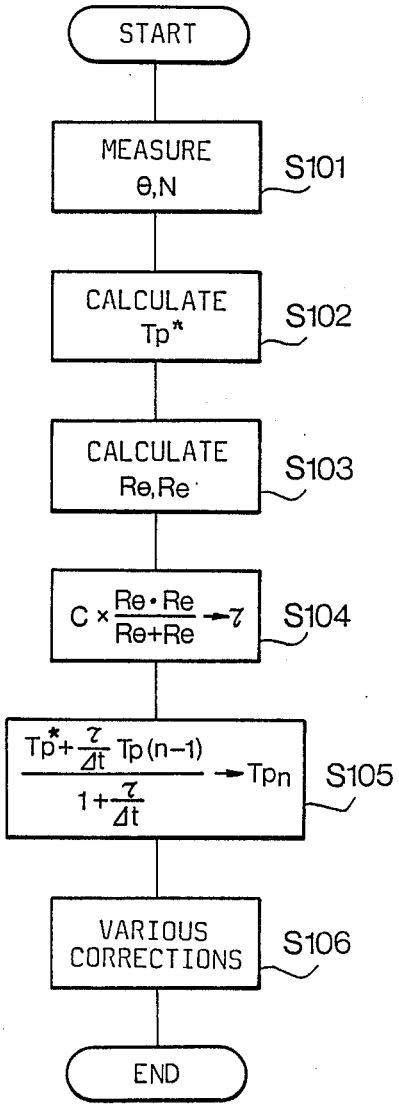
FIG. 4 is a flowchart showing the operation of the system of FIG. 3.

The operation of the system is described hereinafter with reference to the flowchart shown in FIG. 4. The throttle opening degree $\theta$ is obtained from the output signal of throttle position sensor 7, and engine speed N is calculated based on the output signal of crank angle sensor 9 (step S101). At a step S102, the basic injection pulse width Tp* is derived from the table in the section 14. The resistances $R_\theta$ and Re are derived from the $R_\theta$ and Re tables 15, 16 in accordance with the throttle opening degree $\theta$ and engine speed N (step S103). The time constant $\tau$ is calculated at the time constant calculator 17 based on the signals $R_\theta$, Re and C (step S104). The basic injection pulse width $Tp_n$ for the present program is calculated in dependence on the time constant $\tau$, basic injection pulse width Tp* and the basic injection pulse width $Tp_{n-1}$ calculated at the previous program (S105). The injection pulse width Ti is obtained by correcting the basic injection pulse width $Tp_n$ in dependence on the miscellaneous correction coefficient $K_{COEF}$ and feedback correction coefficient $K_{FB}$ (step S106).

Figures 5A, 5B, 5C, 5D, 5E, 5F:
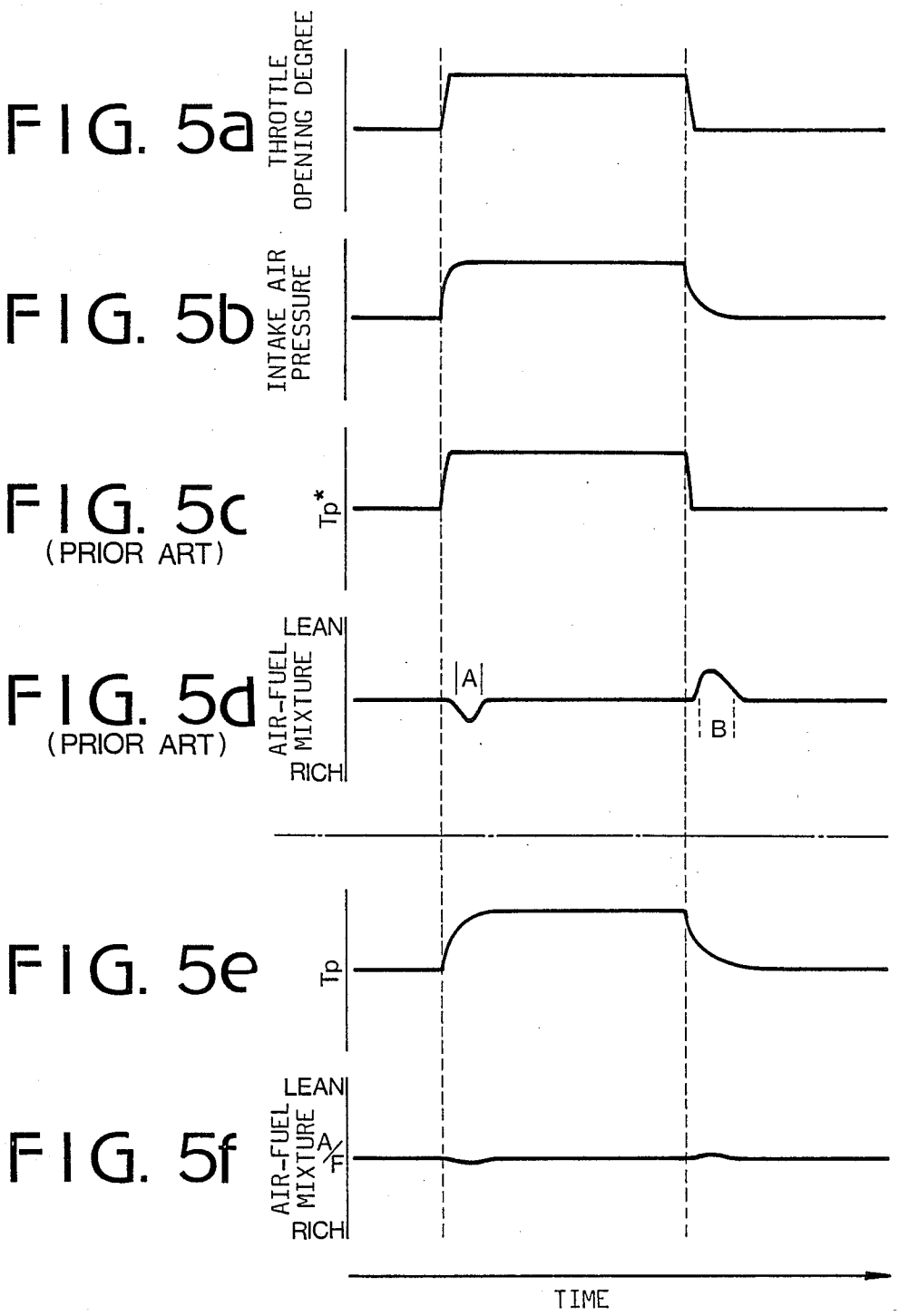
FIG. 5c (PRIOR ART)
FIG. 5d (PRIOR ART)
FIGS. 5*a* to 5*f* show variations of various values.

Referring to FIGS. 5*a* to 5*f*, at a transient state when the throttle valve 3 is rapidly opened or closed (FIG. 5*a*), the pressure in the intake passage increases as shown in FIG. 5*b*. The basic injection pulse width Tp* for the steady state stored in the table varies as shown in FIG. 5*c*. FIG. 5*d* shows the variation of air-fuel ratio in dependence on the basic ignition pulse width Tp* where the air-fuel ratio becomes small (rich mixture) at the acceleration (zone A) and large (lean mixture) at deceleration (zone B).

However, in the system of the present invention, the basic injection pulse width is corrected to have the first order time lag dependent on the capacity of the intake passage. Thus, the corrected basic injection pulse width Tp slowly varies as shown in FIG. 5*e*. Accordingly, the air-fuel mixture becomes neither rich nor lean at the transient state as shown in FIG. 5*f*.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A system for controlling fuel injection of an engine for a motor vehicle having an intake passage, a throttle valve provided in the intake passage, and a fuel injector, the system comprising:

an engine speed sensor producing an engine speed signal dependent on speed of the engine;

a throttle position sensor producing a throttle position signal dependent on the opening degree of the throttle valve;

determining means for producing a basic injection pulse width signal in accordance with the engine speed signal and throttle position signal;

calculator means for producing a delay signal from variables dependent on the engine speed signal and the throttle position signal;

correcting means for correcting the basic injection pulse width signal with the delay signal and for producing a fuel injection pulse width signal for operating the fuel injector.

2. The system according to claim 1 wherein the delay signal is a time constant for providing a first order lag.

* * * * *